United States Patent [19]

Elton

[11] Patent Number: 4,806,203

[45] Date of Patent: Feb. 21, 1989

[54] METHOD FOR ALKALINE DELIGNIFICATION OF LIGNOCELLULOSIC FIBROUS MATERIAL AT A CONSISTENCY WHICH IS RAISED DURING REACTION

[76] Inventor: Edward F. Elton, 1605 Treeridge Pkwy., Alpharetta, Ga. 30201

[21] Appl. No.: 828,003

[22] Filed: Feb. 12, 1986

Related U.S. Application Data

[63] Continuation-in-part of Ser. No. 701,571, Feb. 14, 1985, abandoned.

[51] Int. Cl.[4] ..... D21C 3/26; D21C 9/12; D21C 9/147; D21C 9/18

[52] U.S. Cl. ..... 162/19; 162/37; 162/39; 162/60; 162/65; 162/89; 162/90

[58] Field of Search ..... 162/19, 37, 60, 65, 162/78, 89, 239, 90, 56, 39

[56] References Cited

U.S. PATENT DOCUMENTS

| | | | |
|---|---|---|---|
| 3,251,730 | 5/1966 | Watanabe | 162/56 |
| 3,652,388 | 3/1972 | Croon et al. | 162/65 |
| 3,874,992 | 4/1975 | Liebergott | 162/66 |
| 4,046,621 | 9/1977 | Sexton | 162/60 |
| 4,160,693 | 7/1979 | Lindahl et al. | 162/24 |
| 4,259,150 | 3/1981 | Prough | 162/65 |
| 4,298,427 | 11/1981 | Bentuclzene et al. | 162/65 |
| 4,444,621 | 4/1984 | Lindahl | 162/26 |
| 4,568,420 | 2/1986 | Nunni | 162/65 |

OTHER PUBLICATIONS

Perkins, "Equipment for Rapid Press-Caustic Extraction" Tappi Alkaline Pulping Conference, Oct. 1975; Williamsburg, Va.

*Primary Examiner*—Steve Alvo

*Attorney, Agent, or Firm*—Thomas & Kennedy

[57] ABSTRACT

A process is disclosed for the pretreatment of lignocellulosic fibrous materials prior to delingification. The process in one of its embodiments is comprised of the following steps:

1. Contacting the pulp material with treated filtrate and alkali for a short reaction period of about 1 to 2 minutes at 40° C.,
2. Withdrawing part of the liquid phase by filtration,
3. Displacing substantially all of the remaining liquid phase with treated filtrate, and
4. Allowing the pulp to react under conditions normally used for alkaline extraction or oxygen delignification.

The treated filtrate is obtained by subjecting the liquor removed from the pulp at steps 2 and 3 to temperature of 5° to 60° C. for periods of about 5 to 10 minutes. Alternatively, step 3 can be eleminated.

26 Claims, 4 Drawing Sheets

METHOD FOR ALKALINE DELIGNIFICATION OF LIGNOCELLULOSIC FIBROUS MATERIAL AT A CONSISTENCY WHICH IS RAISED DURING REACTION

This application is a continuation-in-part of Ser. No. 701,571, filed 2/14/85, and now abandoned.

BACKGROUND OF THE INVENTION

In the preparation of papermaking pulps from lignocellulosic materials it is often desirable to bleach the pulps to obain a whitened product. Numerous methods of bleaching pulp are practiced and have been described in a variety of publications (Rapson, W. H., Editor, *The Bleaching of Pulp,* TAPPI Monograph Series No. 27, TAPPI, New York 1963; Singh, R. P., Editor, *The Bleaching of Pulp,* Third Edition, TAPPI, Atlanta 1979). Certain of these prior art bleaching processes require multiple treatment steps to remove lignin and other "color bodies" from the pulp. It is a characteristic of most bleaching processes that expensive chemicals and process equipment are required to obtain relatively small changes in the purity and brightness of the product pulp. For example, to obtain wood pulp of 90 brightness from softwood kraft pulp it is often necessary to use five stages of bleaching under conditions such as in Table I. The bleach sequence and conditions outlined in Table I, while typical, only represents one of a large number of bleach sequences in common use by the pulp industry.

TABLE I

Typical Reaction Conditions for SW Kraft Bleaching

| Stage | Active Chemical | % Chemical on Pulp | Consistency % | Temperature Deg. C. |
|---|---|---|---|---|
| 1 | chlorine | 6 | 3.5 | 35 |
| 2 | alkaline extraction | 3 | 12 | 60 |
| 3 | chlorine dioxide | 1 | 12 | 70 |
| 4 | alkaline extraction | .5 | 12 | 60 |
| 5 | chlorine dioxide | .2 | 12 | 70 |

The waste products of the bleaching process are known to contain BOD, organically bound chlorine and color. Thus, they contribute to the water pollution discharged from the pulp mill.

The efficiency of the bleaching reactions is hampered by the existence of condensation reactions. This can be particularly true in the alkaline extraction step where condensation reactions block further delignification. A publication by Seymour (Seymour, G. W., "Cost Reducing Bleach Plant Control Strategy," *Seminar Notes,* 1977 *Bleaching Seminar on Chlorination and Caustic Extraction,* TAPPI, Washington, D.C., Nov. 10, 1977) reports that the amount of caustic applied in the extraction stage can be doubled beyond normal with practically no reduction in bleach chemical usage in the following stages.

It is a continuing objective of the pulp industry to reduce overall bleaching costs by improving efficiency in the various process steps. Improved efficiency can result in lower costs by reduction of chemical usage or reduction of the number of process steps. An additional benefit of improved efficiency can be a lowering of pollutant discharge.

Past Attempts to Solve the Problem

Lachenal, et al, (Lachenal, D., Wang, S. J., and Sarkanen, K. V., "Non-surfur Pulping of Wheat Straw," *TAPPI Proceedings,* Pulping Concerence, Houston, TX, October 1983) have found that with sodium carbonate as the pulping agent two stage pulping of wheat straw is more efficient than one stage pulping. If the spent liquor is removed after the first stage, even greater efficiency is achieved. This they cite as evidence of the importance of the condensation reactions in alkaline delignification.

Hot alkaline extraction of the unbleached pulp has been proposed to improve bleach plant efficiency. This is sometimes referred to as pre-bleaching or pre-delignification. The objective is to reduce bleach costs by reducing the kappa number (lignin content) of the pulp before it enters the bleach plant. In this way a corresponding reduction in the amount of more expensive bleaching agents is achieved. More recently, oxygen delignification has been the subject of a number of U.S. patents (Verreyne, A. J., Rerolle, P., Richter, J., and Job, L. A., U.S. Pat. No. 3,660,225—May 2, 1972; Schleinkofer, R. W., U.S. Pat. No. 3,703,435—Nov. 21, 1972; Samuelson, H. O., and Croon, I. L. A., U.S. Pat. No. 3,759,783—Sep. 18, 1973; Roymoulik, S. K., and Brown, K. J., "Delignification and Bleaching of a Cellulose Pulp Slurry with Oxygen," U.S. Pat. No. 3,832,276—Aug. 27, 1974; Kikuiri, M., Nakashio, Y., Arai, Y., and Hidaka, T., "Process for Producing Alkali Pulp," U.S. Pat. No. 4,274,913—June 23, 1981; Bentvelzen, J. M., Meredith, M. D., Bepple, H., Torregrossa, L. O., Battan, H. R., and Justice, D. H., "Treating Pulp with Oxygen," U.S. Pat. No. 4,295,925—Oct. 20, 1981; Bentvelzen, J. M., Meredith, M. D., Bepple, H., Torregrossa, L. O., Battan, H. R., and Justice, D. J., "Method and Apparatus for Treatign Pulp with Oxygen," U.S. Pat. No. 4,295,926,—Oct. 20, 1981; Markham, L. D., Elton, E. F., Magnotta, V. L., "Method and Apparatus for Oxygen Delignification," U.S. Pat. No. 4,384,920—May 24, 1983; Annergren, G. E., Hagglund, T., Lindblad, P., Lindstrom, L. T., and Nasman, L. E., "Method for Delignification of Lignocellulose-containing Fiber Material with an Alkali Oxygen Extraction Stage," U.S. Pat. No. 4,451,332—May 29, 1984) as a pre-bleaching step to lower the kappa number of pulp prior to bleaching. In this instance the unbleached pulp is contacted with oxygen and alkali under conditions of elevated temperature and pressure for time periods which are typically about 15 to 30 minutes. The industry has been slow to adopt this technique, however, because it requires expensive equipment for its implementation.

At an earlier time, the "cold soda" process was developed (*The Bleaching of Pulp,* Rapson) principally as a means to remove hemicellulose and thus improve alpha-cellulose content of dissolving grade pulp. This process can be applied to pulps at any stage in the bleaching or purification sequence including pulps which have been hot alkaline-extracted. Optimum temperatures for cold caustic extraction range between 15° and 25° C. and treatment times, between 15 and 60 minutes.

Oxygen has been used to enhance lignin removal in the extraction stage. Kemph and Dence (Kemph, A. W., and Dence, C. W., "Structure and Reactivity of Chlorolignin," *TAPPI, Vol.* 53, no. 5, pp. 864–873, May 1970) reported significant reductions in permanganate number after extraction of chlorinated pulp in an oxygen atmosphere. Tests which they conducted in an air atmosphere also showed an improvement although it was only about 1/5th as large as the effect noted with oxygen. More recently, based on improved methods of mixing pulp and oxygen such as disclosed in U.S. Pat. Nos. 3,832,276 and 4,451,332, the commercial use of oxygen in the extraction stage has grown rapidly worldwide.

Elton describes the two most common systems for oxygen extraction (Elton, E. F., "Oxidative Extraction Process Is Now Well Accepted but Still Has Hazards," *Pulp & Paper,* pp. 71–73, August 1984). For both types of systems, sodium hydroxide is added to the pulp after it leaves the chlorination stage washer and prior to the addition of oxygen to a mixing device. The alkaline pulp suspension, containing a fine dispersion of oxygen, is either introduced into the bottom of the extraction tower or, when extraction is in a downflow toner, into a pre-retention tube.

While oxygen extraction is effective at improving efficiency, it does create some added problems. These are the need to handle oxygen, a potentially hazardous chemical; the added expense of the oxygen; and the need to provide adequate ventilation to prevent buildup of toxic and combustible gases.

The use of hydrogen peroxide has also been used to enhance lignin removal in the extraction stage (The Bleaching of Pulp, Singh). While this is a relatively simple method, its application does require the added expense of peroxide.

Another method of alkaline extraction of chlorinated pulp is disclosed by Liebergott in U.S. Pat. No. 3,874,992. In this method, the mixture of pulp and alkali is pressed to a high consistency within about 5 minutes after mixing the hot alkali and the pulp. The method reports results equal to those achieved with conventional alkaline extraction.

SUMMARY OF THE INVENTION

This invention teaches an improved method of conducting alkaline extraction of pulp. It is preferably employed in one or more of three locations:

1. Before conventional bleaching, i.e., as a pre-bleach;
2. In the extraction stage of a conventional bleach sequence; or,
3. In conjunction with a conventional oxygen delignification stage.

The present invention is based on a surprising discovery relating to alkaline treatment of pulp. It was found that pulp delignification can be improved if a portion of the liquid phase is removed from the reacting mixture after only a short time (0.5 to 10 minutes) of reaction. The pulp is then allowed to continue to react with the remaining liquid solution for a normal period of time (30 to 90 minutes). This suggests that during the initial phase of reaction, substances are formed which either reverse or inhibit pulp delignification.

It was further learned that the liquid phase, after being removed from the pulp suspension, can be treated to alter, remove, or otherwise deactivate those substances which reverse or inhibit the delignification process, thus making the liquid phase suitable for reuse in delignification or extraction. One such method of treatment is to heat the liquid phase for a period of time ranging from about 5 minutes or longer, depending on reaction temperature. The reuse of the treated liquid phase can be accomplished either by adding it to fresh pulp or by re-adding it to the original pulp. This is not intended to imply that reuse of the liquor is limited to these two means.

Thus, it is an object of this invention to provide a process for improving pulp delignification in a paper making system by mixing the pulp material with alkali and its carrier liquid for a short period, withdrawing the liquid phase of the mixture after a short period and continuing thereafter to react the pulp and the alkali for a normal period.

Another object of this invention is to provide an improved process of pulp bleaching and delignification in a paper making process by reducing condensation reactions between dissolved and undissolved lignin, by the adding of an alkaline mixture to the pulp and, after a short period, withdrawing a major portion of the liquid phase of the alkaline mixture and continuing to react the remaining pulp solution.

Another object of this invention is to provide a process whereby in a paper making system a portion of the liquid phase of an alkaline mixture which is added to the pulp is withdrawn from the pulp suspension and the withdrawn liquid is reused as an additive with the alkaline mixture that is combined with the pulp.

Other objects, features and advantages of the invention will be understood upon reading the following specification, when taken in conjunction with the accompanying drawings.

DETAILED DESCRIPTION OF THE INVENTION

Figure 1:
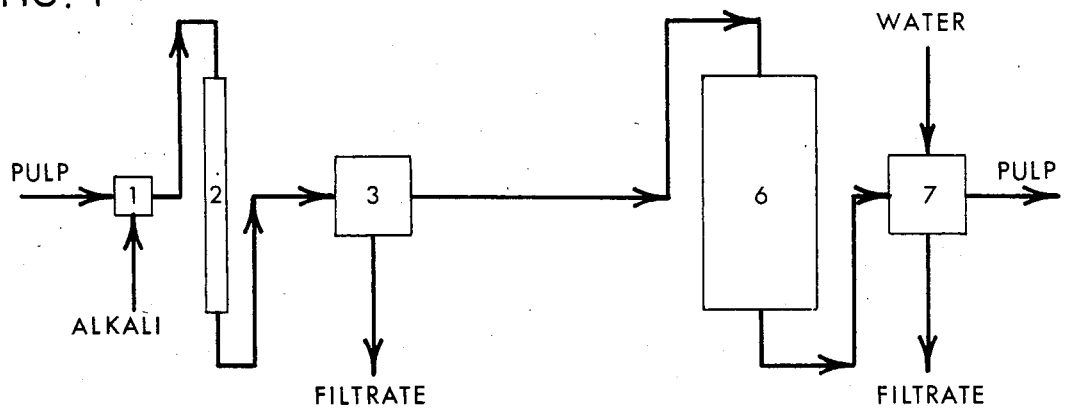
FIG. 1 is a flow diagram which illustrates how one process of the invention can be practiced.

Referring now in more detail to the drawings, wherein like numerals indicate like parts throughout the several views, FIG. 1 illustrates the first, most simplified embodiment of the invention, wherein either unbleached chlorinated or partially bleached wood pulp is blended with a suitable alkali, such as NaOH, in a mixer 1 at a pulp consistency between about 0.01% and 30%, preferably about 7 to 15%. Alternately, the alkali can be combined with the pulp by distributing it on a sheet of pulp so that the natural capillary forces will distribute the alkali throughout the pulp. The amount of alkali added can be the same or, greater or less than the amount normally used for extraction, delignification or oxygen delignification. The alkaline pulp suspension is next carried into the reactor 2 where it is treated for 0.5 to 10 minutes or longer depending upon the reaction temperature. Table II shows the approximate relationship between optimum reaction time and temperature.

TABLE II

| Temperature Deg C. | Approximate optimum time in Reactor 2 in minutes |
|---|---|
| 23 | 4–7 |

TABLE II-continued

| Temperature Deg C. | Approximate optimum time in Reactor 2 in minutes |
|---|---|
| 29 | 1.5–4 |
| 35 | 1.0–3.0 |
| 40 | 1.0–2.0 |
| 50 | 0.5–1.5 |

It is important to note that other factors such as effectiveness of mixing, species of lignocellulosic material, and prior treatment of the pulp can influence the optimum time of treatment. The values of Table II, therefore, are approximate; and different specific applications of the invention could show some variance of optimum treatment time. Treatment times longer or shorter than the values reported in Table II can be used; but if the treatment time is too short or too long, the effectiveness of the method is reduced.

Following the relatively short reaction time in reactor 2, a portion of the liquid phase is removed by filtration of the alkaline pulp suspension in the filter 3; and the thickened pulp slurry is conveyed to the reaction vessel 6. The amount of filtrate removed from the pulp slurry at the filter 3 is adjusted to be less than approximately 90% of the liquid phase of the mixture and preferably between 40 and 70% of the liquid phase present with the pulp in the reactor 2. The pulp slurry which passes to the reaction vessel 6 should contain sufficient entrained chemical to complete the delignification reaction in the vessel.

The conditions of time and temperature applied in vessel 6 can be those normally applied to the pulp for the stage of processing at which this invention is being practiced. Thus, if practiced with alkaline extraction of chlorinated pulp, vessel 6 could be operated at 60° to 70° C. and 30 to 90 minutes; and if practiced with oxygen delignification, vessel 6 would be operated at about 100° C. and 100 psi for 15 to 45 minutes. Further, if operated as an alkaline pre-delignification, vessel 6 might be operated between 70° and 100° C. for 15 to 45 minutes. The amount of alkali present in vessel 6 can be considerably less than is normally used for the corresponding process practiced without the improvement of this invention.

The final washer 7 is optional. It is included because it represents good bleaching practice. It is not meant to limit this invention to systems which include washing after the reaction vessel 6.

Figure 2:
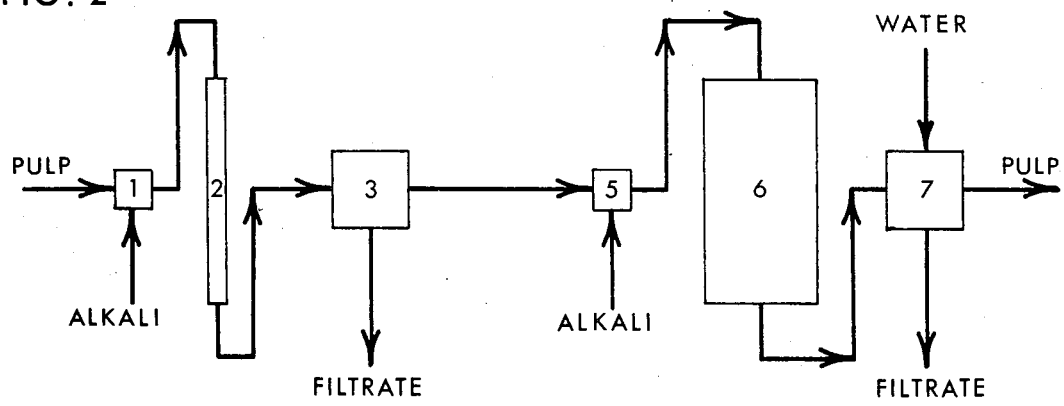
FIGS. 2–7 are flow diagrams, similar to FIG. 1, but illustrating how alternate processes of the invention can be practiced.

A second embodiment of the invention is shown in FIG. 2. This differs from FIG. 1 by the inclusion of a second mixer 5 in the process line between the filter 3 and the reaction vessel 6. In this method, the alkali required for reaction is added in two parts, the first part at the mixer 1 and second part at the second mixer 5. By conducting the process in this manner, there are no restrictions on the fraction of the liquid phase removed at the filter 3 other than those imposed by the mechanics of operation of the filter. Thus, when it is possible to remove 95 to 100%, substantially all of the liquid from the pulp exiting reactor 2, this would be acceptable. The relationship between optimum time of treatment and temperature in reactor 2 is substantially the same as that given in Table II for the first embodiment of this invention. Best results are obtained when between 50 to 80%, and preferably about 55 to 70%, of the alkali requirement is added at the mixer 1 and the remainder at the second mixer 5. Conditions in the reaction vessel 6 and washer 7 are similar to those for FIG. 1.

Figure 3:
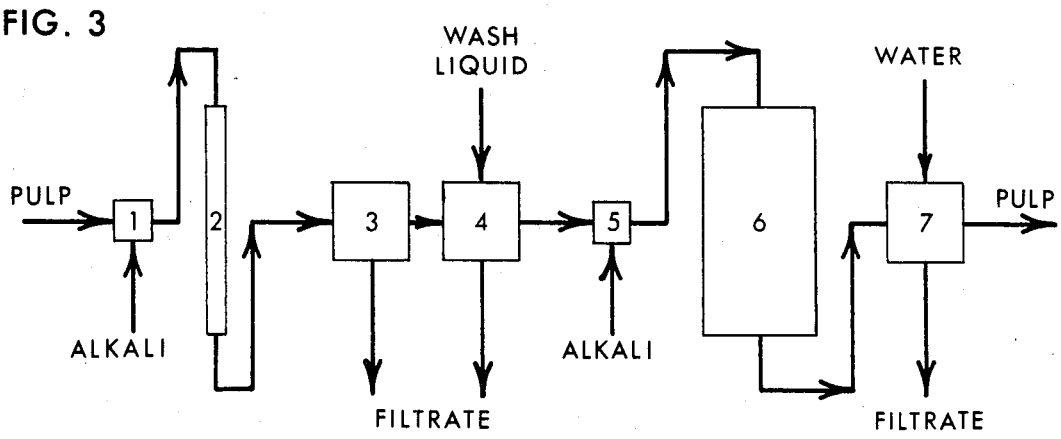

In a third embodiment of this invention as shown in FIG. 3, a washing step 4 is added between the filter 3 and the mixer 5. This improves the degree of removal of the liquid phase. Alternatively, the filter 3 and washer 4 can be combined into one unit by using a conventional pulp washer employing a filtration step followed by a displacement wash. The wash liquid used can be either water or fresh alkali solution. Filtrate from the final washer 7 can be reused as the wash liquid if it is suitable. For alkaline extraction of chlorinated pulp as illustrated in FIG. 3, the optimum dosage of alkali at mixer 1 is between 50 and 80% and preferably between 55 and 65% of the total alkali charged, with the remainder applied at the second mixer 5. Conditions in the reaction vessel 6 and washer 7 are similar to those for FIGS. 1 and 2.

Figure 4:
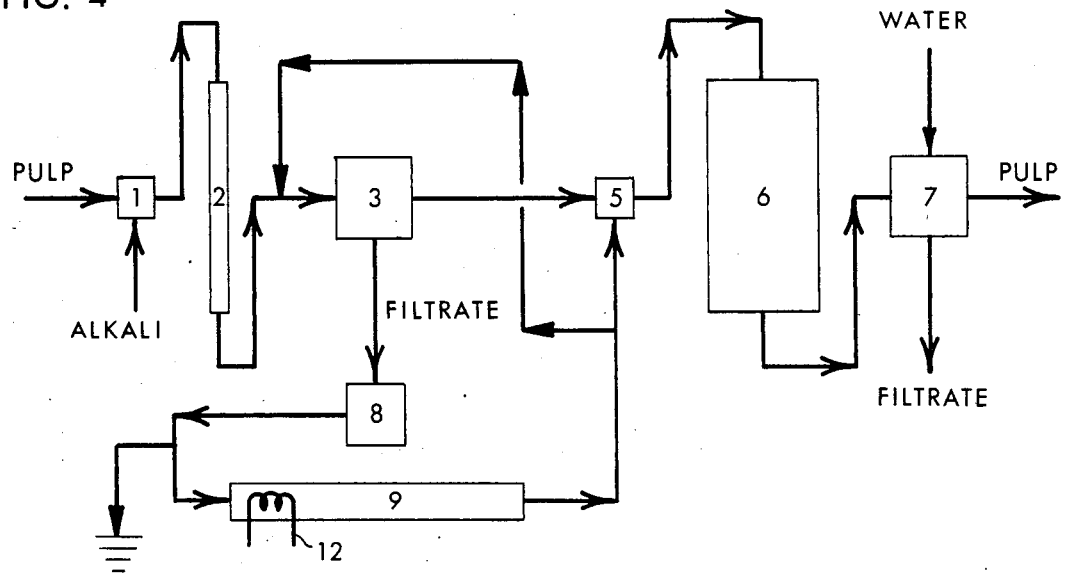

The fourth embodiment of this invention is shown in FIG. 4. The arrangement is the same as in the embodiment illustrated in FIG. 2 with the exception that the entire charge of alkali is added at the mixer 1 and filtrate from the filter 3 is collected in a tank 8. Some of the filtrate is treated in the filtrate reactor 9 and re-added to the pulp either at the mixer 5 or between reactor 2 and filter 3 or at both places. The portion of the filtrate which is not treated in reactor 9 can be discarded. The amount of filtrate removed from the system at this point is determined by the consistencies of the feed pulp and the pulp entering reactor 6. It is possible to operate the process without discarding filtrate at this point but generally it is advantageous to discard a volume of filtrate equal to about 40 to 70% of the total volume of liquid contained in the pulp and the alkali entering mixer 1 although larger amounts can sometimes be discarded. Typically, pulp will enter reactor 2 at between 8 to 15% consistency and have a consistency of between 8 and 25% as it enters reactor 6. Reaction conditions in the reactor 2 are similar to those previously given in Table II. Valves (not shown) in the lines of FIG. 4 can be used to control the flow.

It has been determined that holding the filtrate in the filtrate reactor 9 of FIG. 4 for a period of 5 to 12 minutes at 60° C., or 8 to 60 minutes at 50° C., gives satisfactory results. Consistent with the normal reaction kinetics theory, longer holding times would be required at lower temperatures and shorter times at higher temperatures. Heater 12 comprises a provision for adding heat to the filtrate reactor 9 as shown in FIG. 4. Most of the heat requirement for the reaction in vessel 6 could be added to this point.

Conditions in the reaction vessel 6 and washer 7 are similar to those for FIGS. 1, 2 and 3.

Figure 5:
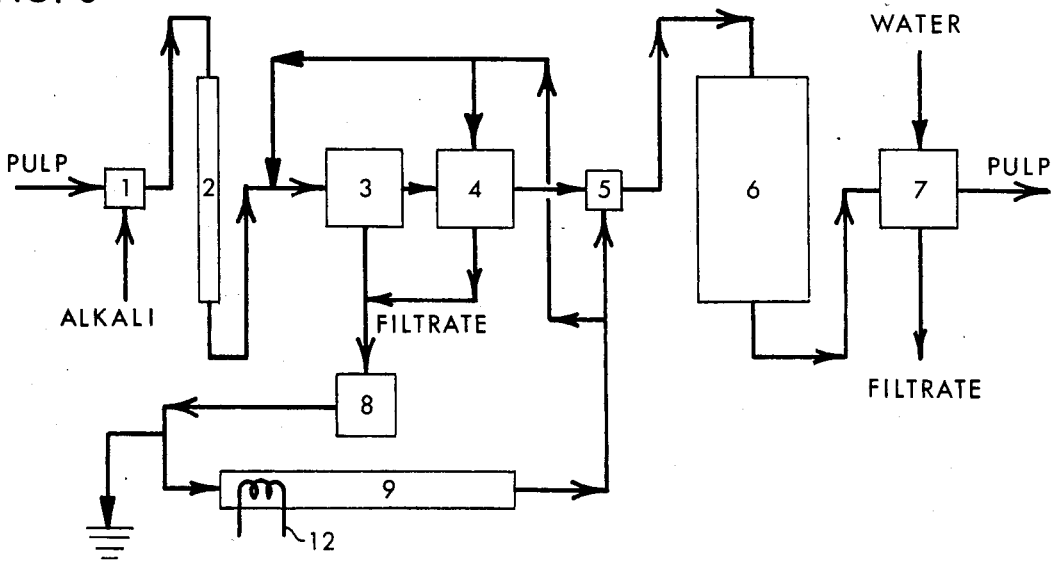

A fifth embodiment of this invention is shown in FIG. 5. This is the same as FIG. 4 except for the inclusion of a washer 4 between the filter 3 and the mixer 5 in the line of process flow. In this case the pulp is washed with treated filtrate from the filtrate reactor 9 to remove additional traces of entrained liquid phase which remain in the pulp after filtration. It is possible to use the treated filtrate only at the washer 4 in FIG. 5. Alternately, in addition to using treated filtrate to wash the pulp at the washer 4, additional treated filtrate can be added to the pulp either at the mixer 5 or between reactor 2 and filter 3 or at both places. Valves (not shown) in the lines of FIG. 5 can be used to control the flow. As in the third embodiment, the filter 3 and washer 4 can be combined into one unit. Additional treated filtrate is added to the pulp at the mixer 5 if needed, or alternately, the mixer 5 can be eliminated and the pulp conveyed to the reaction vessel 6 for further processing.

Reaction conditions in the filtrate reactor 9 are the same as in the fourth embodiment (FIG. 4). Conditions in the reaction vessel 6 and washer 7 are similar to those for FIGS. 1, 2, 3 and 4.

Figure 6:
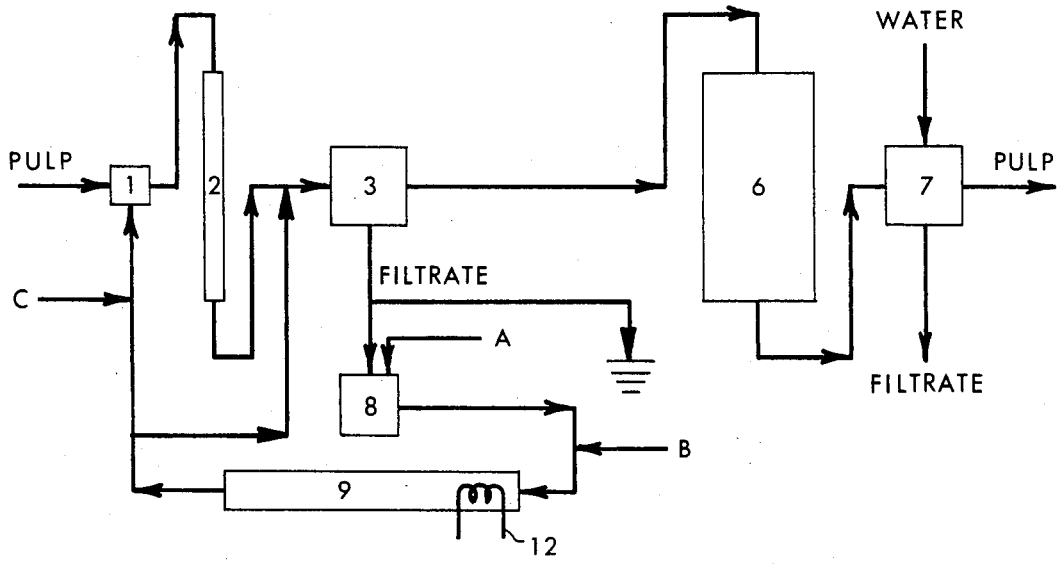
Figure 7:
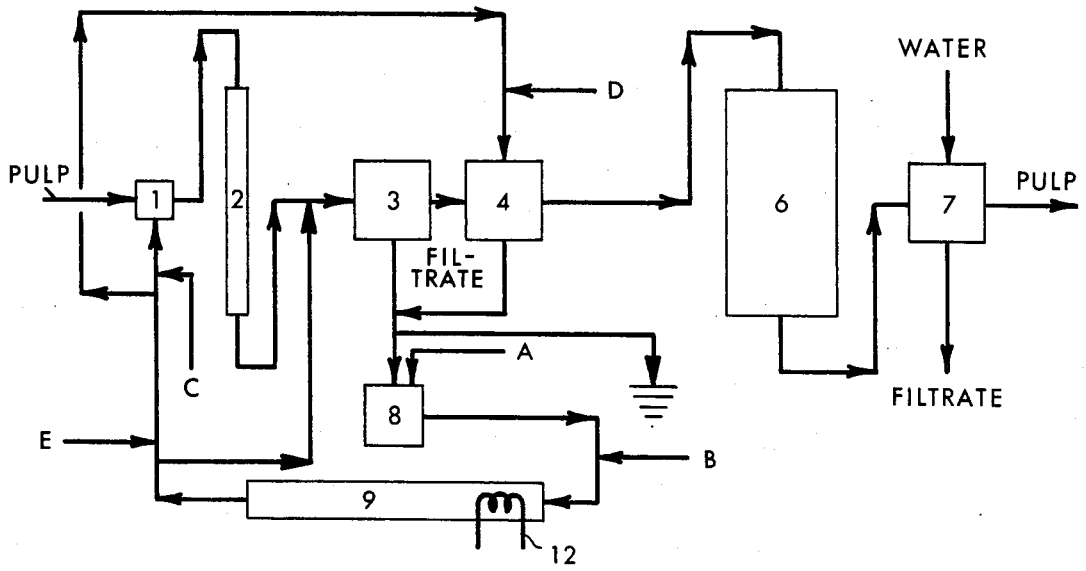

The sixth and seventh embodiment of this invention are shown in FIGS. 6 and 7. By utilizing recycle of the treated filtrate, it is possible to use higher amounts of alkali at the mixer 1 and reactor 2 thus facilitating the removal of lignin.

In the embodiment of the invention shown in FIG. 6, chlorinated or unbleached pulp is blended with treated filtrate from the filtrate reactor 9 in the mixer 1. Alternatively, the treated filtrate is sprayed or otherwise distributed on a sheet of pulp allowing the natural capillary forces to distribute the filtrate. The temperature of the pulp suspension at this point will depend on the temperatures of the streams entering the mixer and usually will be in the range of 40° to 60° C. After a short retention in reactor 2 following the guidelines of time and temperature described in embodiment one and listed in Table II, the slurry is then filtered, or dewatered at filter 3. Prior to the filtration step, treated filtrate may be used to dilute the pulp although this dilution is optional. The optimum liquid removal by filter 3 in the system of FIG. 6 is between 70 and 90% removal, but 30 to 70% liquid removal would still provide significant benefits. However, liquid removal rates of 75 to 90% are easily achieved commercially. Table III shows, for the system of FIG. 6, some values for consistency entering filter 3 and entering the reactor 6 that will result in 67%, 80% and 90% removal of the liquid phase at the filter 3.

TABLE III

| % Liquid phase removed at filter 3 | % Consistency entering filter 3 | % Consistency entering reactor 6 |
|---|---|---|
| 90 | 1.0 | 9.2 |
| 90 | 2.0 | 16.9 |
| 90 | 3.5 | 26.6 |
| 80 | 2.0 | 9.3 |
| 80 | 3.5 | 15.4 |
| 80 | 5.0 | 20.8 |
| 67 | 3.5 | 9.9 |
| 67 | 5.0 | 13.8 |
| 67 | 10.0 | 25.0 |

The process operates best when the alkali charge to the first stage is maximized. After filtration at filter 3, the resulting thickened pulp slurry will carry forward sufficient alkali in the entrained liquid phase to complete the delignification reaction. The conditions of time and temperature in the reaction vessel 6 and washer 7 can be the same as those stated in the first embodiments of this invention (FIGS. 1 thru 5).

Some of the filtrate from the filter 3 of FIG. 6 is collected in the tank 8 and treated in filtrate reactor 9 prior to being recirculated to the mixer 1 and the optional dilution point between reactor 2 and filter 3. The portion of the filtrate which is not received in tank 8 for treatment in reactor 9 can be discarded. As stated in embodiment four of this invention (FIG. 4), it is possible to operate the process without discarding filtrate but an improved result is achieved by discarding a volume of filtrate equal to about 40 to 70% of the total volume of liquid contained in the pulp entering the mixer 1 and in the fresh alkali entering the process. Valves (not shown) in the lines of FIG. 6 can be used to control the flow.

Heater 12 comprises a provision for adding heat to the filtrate reactor 9. This provides the elevated temperature desired for filtrate treatment. Holding periods in filtrate reactor 9 ranging from 8 to 60 minutes at 50° C. have been used successfully. The short treatment time is preferred because it requires the smallest reactor size for implementation. As stated in the discussion of embodiment four, at a temperature of 60° in filtrate reactor 9, a holding period between 5 and 12 minutes is sufficient.

The temperature of the pulp mixture entering reactor 2 of FIG. 6 is determined by the temperatures and consistencies of the streams entering the mixer 1. Since it is an advantage to use elevated temperature to treat the filtrate in filtrate reactor 9, the temperature of the pulp stock entering the reactor 2 will be correspondingly high. Typical of the values which might be encountered would be pulp stock at 35° C. and 15% consistency moving to mixer 1 and filtrate at 60° C. recirculating from filtrate reactor 9 to mixer 1 which results in the feed from mixer 1 to reactor 2 having a temperature of about 50° C. and a consistency of 5.6%.

Referring to FIG. 6, fresh alkali can be added to the system either at the tank 8 (point A), at the inlet to the filtrate reactor 9 (point B) or at the outlet of the filtrate reactor 9 (point C). Wherever added, sufficient agitation from normal flow conditions in the system should be available to disperse the alkali evenly throughout the filtrate. If not, it would be desirable to provide a means for agitation. It is, of course, possible to add fresh alkali to the pulp at a point before it enters the Mixer 1, for example, by adding it in the pulp conveyor or spraying it on the washer or in the pulper of the previous stage (not shown).

The seventh embodiment of this invention shown in FIG. 7 differs from the sixth by the inclusion of a washer 4 in the process flow between the filter 3 and the reaction vessel 6. The washer uses treated filtrate from the filtrate reactor 9 to displace liquor remaining in the pulp after filtration by filter 3. The inclusion of the washer 4 allows more complete removal of the liquid phase by replacing it with treated filtrate. It is desirable to operate according to the guidelines of embodiment six with alkali charge to the reactor 2 as high as practical. This is accomplished by maximizing withdrawal of liquid phase between reactors 2 and 6. The washing step improves efficiency of liquid phase removal without requiring low consistency entering the filter. As in embodiment 6, the addition of treated filtrate to the pulp between the reactor 2 and the filter 3 is optional. Valves (not shown) in the lines of FIG. 7 can be used to control the flow.

In the system of FIG. 7 the best point of alkali addition would be point C which causes the fresh alkali to be blended directly with the treated filtrate being recycled to the mixer 1. One skilled in the art will recognize that this maximizes the alkali charge to the reactor 2. Locations A, B and E of the system of FIG. 7 would be alternate locations for alkali addition, and location D the least desirable point of alkali addition. Conditions in the filtrate reactor 9 are similar to those used in FIGS. 4, 5 and 6.

As in embodiment six, fresh alkali could be added to the pulp upstream of the mixer 1 of FIG. 7. Conditions applied to the pulp suspension in the reaction vessel 6 are the similar to those specified in the other embodiments. Further, as in all of the other embodiments, the washer 7 is optional.

Equipment Specifications

The mixers 1 of FIGS. 1–7 and 5 of FIGS. 2–5 can be chosen from equipment already available to the pulp industry including, but not limited to, static mixers, high shear mixers, and stirred tank mixers.

The reactor 2 can be any vessel of appropriate size to provide sufficient residence time for the first stage reaction. The vessel should ideally be designed to minimize backmixing. Therefore, a long tubular reactor such as a pipeline, tall tower or stand pipe would be suitable. It would be desirable to have the flexibility to adjust the residence time in reactor 2 to allow response to changes in operating temperature. Numerous methods to do this are known to those skilled in mechanical design of reactors.

The filter 3 could be chosen from equipment already available to the industry including but not limited to such devices known as sidehill screens, extractors, deckers, drum filters and belt filters. It will be apparent to one skilled in the art that for the embodiments in which the filter 3 and washer 4 are used together (FIGS. 3, 5 and 7), these can be combind by using a conventional pulp washer employing a filtration step followed by displacement (not shown). If a separate washer is used, those commonly employed by the pulp industry such as diffusion washers, pressure washers or wash presses are acceptable.

If used for alkaline extraction, the reaction vessel 6 can be any one of the types commonly used for extraction. Its major purpose is to provide sufficient residence time and temperature for completion of the extraction reaction. If the process is to be used in conjunction with oxygen delignification, the reaction vessel 6 can be any of the oxygen delignification systems commonly used for that purpose.

The tank 8 (FIGS. 4–7) can be any standard filtrate or seal tank commonly used in the pulp industry. Its purpose is to serve as a collection point for filtrate and provide a barometric seal whenever a vacuum filter is used for filter 3. Tank 8 could be eliminated from the systems without significantly altering the efficiency of the system.

The filtrate reactor 9 (FIGS. 4–7) is constructed to provide the necessary residence time (5 to 10 minutes) for filtrate treatment with a minimum of backmixing. Filtrate reactor 9 includes a heater 12 to add the heat to the filtrate, which will raise the temperature of the filtrate to its reaction temperature of 50° to 60° C. A pipeline reactor with indirect steam heating would be acceptable as a filtrate reactor.

Figure 8:
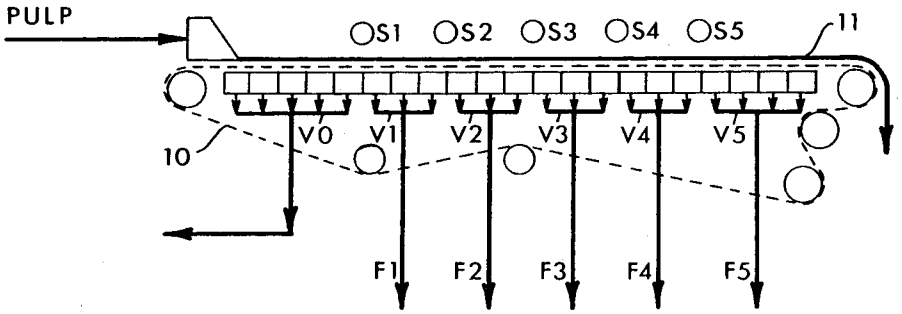
FIG. 8 is a side schematic illustration of a washing system used to wash waste liquor from the wood pulp and to add other liquors to the pulp, and which can be used to practice an alternate process of the invention.

An alternative system which replaces mixer 1, reactor 2, filter 3 and washer 4 is shown in FIG. 8. A pulp mat 11 is formed on a continuous moving belt or filter cloth 10 and dewatered as it passes over the first section of vacuum boxes V0. Alkali solution or treated filtrate is then distributed evenly over the surface of the pulp mat 11 from the shower S1 allowing the natural capillary forces to saturate the pulp mat with extraction liquor. Some of the liquid can be drawn through the pulp mat by the application of vacuum on the underside of the filter cloth at V1. This will have the effect of improving the uniformity of liquor distribution in the pulp mat. As the pulp is transported along with the moving filter cloth the first stage of reaction takes place. This will require a residence time of the pulp and alkali solution on the moving filter cloth of up to about 10 minutes, depending on the temperature of the mixture. It could be desirable to add one or more additional filtration stations along the length of the filter cloth to exchange the liquid phase in the moving pulp mat with freshly treated filtrate or fresh alkali solution. The showers S2, S3 and S4 and the vacuum boxes V2, V3 and V4 are provided for this purpose. At the end of the desired residence time, the liquid phase is withdrawn by vacuum box V4 and after the liquid phase has been withdrawn from the pulp mat, the pulp mat 11 is washed with treated filtrate or fresh alkali solution by shower S5. This washing is accomplished by spraying the wash liquid on the pulp mat from the shower S5 and drawing the liquid through the mat 11 by the action of vacuum applied to the underside of the filter cloth by vacuum box V5. From this point the pulp is ready to proceed to the second stage of reaction.

When the system of FIG. 8 is operated without using the showers S2, S3 and S4 and without the vacuum boxes V2 or V3, it acts as a replacement for combined mixer 1, reactor 2, filter 3 and washer 4 of FIGS. 3, 5 and 7. When used for embodiment 3 (FIG. 3), either water or fresh alkali is fed to the shower S5. Alternatively, the filtrates F1, F4 and F5 from vacuum boxes V1, V4 and V5 are combined for treatment in the filtrate reactor 9. Then, when the system of FIG. 8 is used for embodiment 5 (FIG. 5), the treated combined filtrate is fed to the shower S5. Or, when used for embodiment 7 (FIG. 7), the treated combined filtrate is used both at the shower S5 and the shower S1.

In the embodiment of FIG. 8, the use of multiple sets of showers and vacuum boxes for filtration is equivalent to using the process of this invention several times in series. This would result in improved performance over a single application of the process.

There are several possible choices of operation when utilizing the shower and vacuum box system of FIG. 8 as a substitute for multiple applications of the mixer 1, reactor 2, filter 3 and washer 4 of FIGS. 3, 5 and 7. In one method the filtrates F1, F2, F3, F4 and F5 are combined, alkali added and the mixture treated for 10 minutes at 50° C., as discussed in embodiments 4, 5, 6 and 7. The treated, combined filtrate is used to treat the pulp by recycling it to the showers S1, S2, S3, S4 and S5. In another method, the alkali is not added to the combined filtrates before treatment but instead is combined with the portion of the treated combined filtrate which is sprayed on the pulp at shower S1. In yet another method, alkali is added only to filtrate F1 and the filtrates are not combined. Instead, the filtrates are treated separately in separate filtrate reactors of the type illustrated at 9 in FIGS. 5–7 for the required time and temperature and recycled to the showers in the following order. Filtrate F1 is combined with alkali, treated and recycled to shower S1. Filtrate F2 is treated and recycled to shower S2, treated filtrates F3, F4 and F5 are recycled to shower S3, S4 and S5, respectively. In the first method, the concentration of alkali will tend to be distributed evenly along the length of the pulp mat while in the latter method, the highest alkali concentration will occur following the shower S1, and alkali concentration will diminish step-wise with the lowest value occurring after shower S5.

EXAMPLES

Example 1

To demonstrate the process of FIG. 1, previously dried, unbleached softwood kraft pulp having a kappa number of 25.2 was treated with sodium hydroxide. The pulp was well washed, formed into a pad on a heated buchner funnel and saturated to 7.7% consistency by distributing a preheated solution of sodium hydroxide over its surface, simulating the first stage of reaction. After one minute, vacuum was applied to the buchner funnel, and 67% of the liquid phase was removed, bringing the pulp consistency to 20%. The wet pulp was then transferred to plastic bags and placed in a constant temperature bath for 30 minutes, simulating treatment in reaction vessel 6. As a control, one sample of the same pulp was well washed, blended with sodium hydroxide solution to a consistency of 7.7% in a plastic bag, and placed in a constant temperature bath for 30 minutes to simulate normal alkaline extraction.

At the completion of the extraction period, pulps were dispersed in deionized water to 1% consistency, well washed, formed into sheets and analyzed for kappa number using TAPPI Method T236 m-60. The conditions used and results are listed in Taable IV. The dosage of NaOH applied to the pulps is expressed as a weight percentage based on oven dry pulp. Lignin removal is recorded as the change in kappa number of the pulp as a result of treatment.

TABLE IV

| | First Stage | | | Extraction | | |
|---|---|---|---|---|---|---|
| Run No. | NaOH % | Temp. Deg. C. | Liquid Removal % | Temp. Deg. C. | Final Kappa Number | Kappa Change |
| Control* | 3.0 | | 0 | 80 | 22.5 | 2.7 |
| U5 | 3.0 | 60 | 67 | 80 | 21.2 | 4.0 |
| U6 | .94 | 60 | 67 | 80 | 22.4 | 2.8 |
| U3 | 3.0 | 50 | 67 | 70 | 22.1 | 3.1 |

*No first stage treatment

This result shows the benefit of treatment using the process of this invention. Using equivalent amounts of NaOH, a greater amount of lignin removal was achieved in Run No. U5 (48% more) than in the control test as evidenced by the greater change in kappa number. Run No. U6 shows that by using the process of this invention, the NaOH required can be reduced to less than ⅓ that required by the control while still achieving the same amount of lignin removal.

Run No. U3 shows that the process of this invention can also be used to effect a reduction in operating temperature of the extraction while still achieving a small improvement in delignification.

Example 2

A sample of the same unbleached softwood kraft used for Example 1 was delignified with oxygen using the process of FIG. 1. Treatment conditions were the same as in Run No. U3 of Example 1 with the exception that after 67% of the liquid phase was removed on the buchner funnel, the sheet was blanketed with oxygen of 99.5% purity. The oxygen was allowed to permeate the sheet under the action of the vacuum. The sheet was lifted carefully from the filter to preserve its porosity, placed in an oxygen atmosphere inside a plastic bag and treated at 70° C. for 30 minutes. Table V shows the results of this test.

TABLE V

| | First Stage | | | Oxygen Stage | | |
|---|---|---|---|---|---|---|
| Run No. | NaOH % | Temp. Deg. C. | Liquid Removal % | Temp. Deg. C. | Final Kappa Number | Kappa Change |
| U1 | 3.0 | 60 | 67 | 70 | 21.7 | 3.5 |

The result shows that even under the relatively mild conditions used, treatment with oxygen removed 9.7% more lignin than the corresponding test without oxygen.

The following Examples 3 through 12, show the use of this invention for alkaline extraction of chlorinated pulps. The hardwood kraft pulp chosen for these tests had a kappa number of 15.8, and the softwood kraft pulp (kappa 25.2) was the same as used for feed stock in Examples 1 and 2. The pulps were chlorinated for 60 minutes at 3.5% consistency and 35° C. In the chlorination procedure used, a measured quantity of concentrated chlorine/water solution was diluted with sufficient water to give the desired test consistency and immediately blended with 50 gm (o.d. basis) of the prewashed pulp. The reaction mixture, in covered containers, was then placed in a constant temperature bath to carry out the chlorination. Periodic mixing of the pulp suspension was provided during the initial heating up period. The chlorine dosage used for the tests was varied and is reported in the examples to follow. All samples were well washed prior to being used.

After treatment of the pulps according to the methods used in Examples 3 through 11, the pulps were well washed, formed into sheets and analyzed for extracted permanganaate (CEK) number using TAPPI Method T214 m-50. In Example 12, the pulp was well washed and its response to sodium hypochlorite bleaching was measured. Unless stated otherwise, the dosages of chlorine, alkali, and hypochlorite reported in Examples 3 through 12 are expressed as a weight percentage based on oven dry pulp.

Example 3

To demonstrate the process of FIG. 1 on chlorinated pulp, two samples of hardwood which had been chlorinated with 3.2% chlorine were blended with identical amounts of NaOH solution. The first was allowed to react for 1.25 minutes at 40° C. and 10.4% consistency after which 69% of the liquid phase was removed and the thickened pulp, now at 27.2% consistency, was treated for an additional 60 minutes at 60° C. As a control, the second sample was simply treated at 10.4% consistency for 60 minutes at 60° C. without removal of the liquid phase. The amount of alkali blended with the pulps was the same in both cases, 1.91% based on oven dry pulp weight. The results are shown in Table VI.

TABLE VI

| Run No. | Test Description | CEK No. |
|---|---|---|
| HW3 A | process of FIG. 1 | 2.1 |
| HW3 C | control | 2.3 |

This result shows clearly that the process of this invention permits a reduction of extracted permanganate number. One skilled in the art will recognize that this will result in a corresponding drop in the amount of chemicals required for subsequent steps in the bleaching process.

Example 4

The process of FIG. 1 was used for oxygen extraction of chlorinated softwood kraft pulp. The pulp, which had been chlorinated with 4% chlorine, was diluted to 1% consistency and formed into a pad on a buchner funnel. The pad consistency was estimated to be 25%. The pulp was then saturated to 11% consistency by distributing preheated NaOH solution on its surface. The alkali solution contained 3.3% NaOH based on ovendry pulp weight. The pulp, now at a temperature of about 40° C., was allowed to react for 1.5 minutes. Vacuum was then applied to the buchner causing the removal of about 67% of the liquid phase and increasing the pad consistency to about 25%. The thickened pulp was then treated in an atmosphere of pure oxygen gas for 60 minutes at 60° C. and 1 atmosphere total pressure.

As a control, a second sample of the same chlorinated pulp was extracted with 3.3% NaOH at 11% consistency for 60 minutes at 60° C. Oxygen was not used for the control experiment.

The results shown in Table VII demonstrate a 21% reduction in extracted permanganate number.

TABLE VII

| Run No. | Test Description | CEK No. |
|---|---|---|
| SW4 G | process of FIG. 1 using oxygen | 4.5 |
| SW4 H | control, normal extraction | 5.7 |

Example 5

To show the effect of higher alkali dosage on the process of FIG. 1, softwood kraft pulp chlorinated with 4% chlorine was used. The procedure was identical to that used in Example 4 with the exceptions that higher alkali dosages (9.2% vs. 3.3%) were used, the pulp was saturated to 8.3% consistency on the buchner funnel instead of 11%, and after removal of 67% of the liquid phase, the pulp pad had a consistency of 20% instead of 25%. Treatment time in the second stage was 90 minutes instead of 60, and second stage treatments with and without oxygen were tested. The control was reacted at 3.1% alkali and 8.3% consistency for 90 minutes at 60° C. The results are given in Table VIII.

TABLE VIII

| Run No. | Test Description | CEK No. |
|---|---|---|
| E 10 | process of FIG. 1 $O_2$ in second stage | 3.7 |
| E 11 | process of FIG. 1 air in second stage | 4.0 |
| E 12 | process of FIG. 1, gas excluded from second stage | 3.6 |
| E 8 | control, normal extraction | 5.7 |

Comparing the value obtained for run No. E10 with Example 4 shows the higher alkali charge to give a substantial reduction in CEK No. The results also show a better reduction in extracted CEK No. without the use of oxygen than when either oxygen or air are present in the second stage. While the alkali dosage at stage one is about 3 times normal for Runs E10, E11 and E12, only one third of the alkali containing liquid phase is carried forward into the second stage of reaction while the remainder is separated and available for reuse. The 36.8% reduction in CEK number achieved in Run No. E12 is an exceptionally good result.

Example 6

Hardwood kraft pulp was chlorinated with 3.5% chlorine and used in another demonstration of the process of FIG. 1. For this test, first stage consistency, first stage time, and alkali charge to the first stage were varied. The procedure differs somewhat from that used in the previous examples. For the present example, reaction was conducted in polyethylene bags instead of by flooding the buchner funnel. This allowed the use of lower consistencies in the first stage and simulated the use of the mixers. The first stage treatment was conducted at ambient temperature (23° to 24° C.) followed by partial removal of the liquid phase by filtration on a buchner funnel. Enough liquid was removed to give a pulp consistency of about 30% for the second stage of reaction. As in prevous examples, the second stage reaction was conducted in polyethylene bags at 60° C. for 60 minutes. The pulps were compacted to exclude gas from the second stage except for two tests HW1 K and HW1 L. For these two tests the pulp pad was lifted gently from the buchner funnel to retain its porosity, and the second stage of reaction conducted under oxygen for HW1 K and air for test HW1 L. The control tests were conducted at 1.91% alkali, 10% consistency and 60° C. for 60 minutes. The results are shown in Table IX where alkali charge is expressed as percent on an oven dry basis.

TABLE IX

Constant conditions:
First stage temperature = 23–24° C.
Second stage temperature = 60° C.
Second stage consistency = 30%
Second stage time = 60 min.

| | First Stage | | | Second Stage | | |
|---|---|---|---|---|---|---|
| Run No. | Consistency % | Time min. | Alkali % | Gas Phase | Liquid, % carryover | CEK no. |
| HW2 C2 | 6 | 7 | 4.1 | excluded | 14.9 | 1.9 |
| HW2 D1 | 6 | 7 | 9.0 | excluded | 14.9 | 1.6 |
| HW2 D2 | 6 | 3.75 | 4.1 | excluded | 14.9 | 1.9 |
| HW2 C1 | | | (control) | | | 2.1 |
| HW1 F | 1 | 3.5 | 5.7 | excluded | 2.3 | 2.1 |
| HW1 G | 1 | 3.5 | 3.8 | excluded | 2.3 | 2.4 |
| HW1 H | 1 | 4.5 | 11.5 | excluded | 2.3 | 1.8 |
| HW1 J | 1 | 3 | 11.5 | excluded | 2.3 | 2.0 |
| HW1 K | 1 | 3 | 11.5 | oxygen | 2.3 | 1.9 |
| HW1 L | 1 | 3 | 11.5 | air | 2.3 | 2.0 |
| HW1 A | | | (control) | | | 2.1 |

The effect of time in the first stage is shown by examination of Runs HW2 C2, HW2 D2, HW1 H and HW1 J. At the temperatures used for these tests (23°–24° C.) the best results were obtained at treatment times between 3.75 and 7 minutes in the first stage. Some reduction in efficiency was noted when only 3 minutes were used.

Comparison of Runs HW1 H, HW1 J and HW1 K shows that oxygen appears to improve performance when first stage time is short but when additional time is provided in the first stage, oxygen shows no advantage.

The effect of the amount of alkali charged to the first stage is clearly shown with higher levels of alkali resulting in lower final CEK numbers. This suggests that maintenance of high concentration in the first stage is important to achieve optimal results. Note that even at the highest levels of NaOH dosage, only small amounts of the original sodium hydroxide charge is carried forward into the second stage. Expressed as NaOH charged on an oven dry pulp basis, this amounts to 1.34% for run #HW2 D1 and only 0.26% for runs number HW1 H through L. These figures are 70% and 13.6% of the alkali used for the control test respectively.

Example 7

In this series of runs, chlorinated softwood kraft pulp was treated in accordance with the process of FIG. 3. The pulp had been chlorinated with 4.4% chlorine and well washed. Sodium hydroxide solution and pulp were blended in plastic bags at 10% consistency, and 25° C. and immediately placed in a constant temperature bath at 60° C. for periods ranging from 1 to 5 minutes. The pulp was then promptly filtered on a buchner funnel, diluted to 1% with deionized water and filtered again removing approximately 95% of the residual first stage liquid. A second aliquot of NaOH was then blended with the pulp at 10% consistency and 25° C. followed by treatment at 60° C. for 60 minutes. The total charge of NaOH was 3.3% which was divided between the two stages. In one test, the entire alkali charge was added to the first stage with water only added to the second stage. After the second stage the pulp was well washed, formed into sheets and analyzed for CEK number.

Two control tests were run under normal extraction conditions. Alkali charge for the control tests was 3.3% and treatment was at 10% consistency and 60° C. for 60 minutes. Table X lists the results.

TABLE X

Constant Conditions:
First stage consistency = 10%
Second stage consistency = 10%
Second stage temperature = 60° C.
Second stage time = 60 min.

| | First Stage | | | Second Stage | |
|---|---|---|---|---|---|
| Run No. | NaOH % | Time min. | Maximum Temp. Deg C. | NaOH % | CEK No. |
| SW3 C | 1.65 | 1 | 50 | 1.65 | 4.9 |
| SW3 A | 1.98 | 1 | 50 | 1.32 | 4.6 |
| SW3 E | 2.64 | 1 | 50 | 0.66 | 4.8 |
| SW3 G | 3.30 | 1 | 50 | 0 | 5.7 |
| SW3 K | 1.98 | 5 | 60 | 1.32 | 5.0 |
| SW3 L | 2.31 | 5 | 60 | 0.99 | 5.0 |
| SW3 B | | control | | 3.3 | 5.0 |
| SW3 F | | control | | 3.3 | 5.0 |

The results clearly demonstrate that the process of this invention results in more efficient extraction of lignin than conventional extraction as evidenced by the lower CEK numbers in runs SW3 C, SW3 A, and SW3 E. The best result was obtained in run SW3 A in which 60% of the total alkali charge was added at the first stage and 40% at the second stage.

It is important to note that when the first stage treatment was continued for 5 minutes reaching a final temperature of about 60° C., the benefits of the process were reduced to the extent that the final CEK number was the same as in the control runs.

Example 8

Using the process of FIG. 3, a series of runs were made to show the effects of time and temperature in the first stage when the process is used on chlorinated pulps. The softwood samples used were chlorinated at 4% chlorine and the hardwood at 3.2% according to the procedures described previously. The procedure used for this example is the same as for Example 7 with the exception that the alkali solution used for the first stage was preheated before addition to the pulp to permit better control over reaction temperature. The control tests were conducted at 10% consistency and 60° C. for 60 minutes using 3.3% NaOH for the softwood and 1.91% for the hardwood. Results are given in Table XI.

TABLE XI

Constant Conditions:
First stage consistency = 10%
Second stage consistency = 10%
Second stage temperature = 60° C.
Second stage time = 60 min.

| | First Stage | | | Second Stage | |
|---|---|---|---|---|---|
| Run No. | NaOH % | Time min. | Temp. Deg. C. | NaOH % | CEK No. |
| SW4 A | 1.98 | 1.1 | 41 | 1.32 | 5.3 |
| SW4 B | 1.98 | 2.0 | 41 | 1.32 | 5.4 |
| SW4 C | 1.98 | 0.5 | 41 | 1.32 | 5.5 |
| SW4 D | 1.98 | 4.0 | 41 | 1.32 | 5.5 |
| SW4 F | | softwood control | | 3.3 | 5.6 |
| HW3 E | 1.15 | 1.0 | 40 | 0.76 | 2.0 |
| HW3 F | 1.15 | 2.0 | 40 | 0.76 | 2.0 |
| HW3 I | 1.15 | 1.0 | 43 | 0.76 | 2.1 |
| HW3 H | 1.15 | 2.0 | 29 | 0.76 | 2.1 |
| HW3 J | 1.15 | 1.0 | 28 | 0.76 | 2.1 |
| HW3 K | 1.15 | 4.0 | 29 | 0.76 | 2.1 |
| HW3 C | | hardwood control | | 1.91 | 2.3 |
| HW3 G | | hardwood control | | 1.91 | 2.2 |

These results show that at about 40° C., the best results are obtained at first stage treatment times between 1 and 2 minutes although improved extraction is experienced at all treatment times from 0.5 to 4 minutes. For a first stage temperature of 29° C., there was no difference noted when reaction time was varied from 1 to 4 minutes. This is in contrast to the observation in Example 6 where at 23° C. it appeared to be an advantage to conduct the pretreatment for about 4 minutes or longer.

Example 9

The processes of FIGS. 2 and 3 were used for another series of runs to test the effects of first stage consistency and time on chlorinated hardwood kraft pulp. The pulp used for this example was chlorinated at 3.5% chlorine. The procedure was the same as for Example 7 with the exception that the first stage was conducted at ambient temperature and at 1% consistency for three of the tests. The tests at 1% consistency were not washed between stages 1 and 2 while the 10% tests were. Consistency in the second stage was 10% as in Example 7. The results are shown in Table XII.

TABLE XII constant conditions:
First stage NaOH charge = 1.15%
First stage temperature = 25° C.
Second stage NaOH charge = 0.76%
Second stage consistency = 10%
Second stage temperature = 60° C.
Second stage time = 60 min.

| | First Stage | | | |
|---|---|---|---|---|
| Run No. | Consistency % | Time min. | FIG. No. | CEK No. |
| HW1 C | 10 | 2.0 | 3 | 2.0 |
| HW1 D | 1 | 2.0 | 2 | 2.0 |

TABLE XII-continued constant conditions:
First stage NaOH charge = 1.15%
First stage temperature = 25° C.
Second stage NaOH charge = 0.76%
Second stage consistency = 10%
Second stage temperature = 60° C.
Second stage time = 60 min.

| Run No. | First Stage Consistency % | Time min. | FIG. No. | CEK No. |
|---|---|---|---|---|
| HW1 E | 1 | 4.0 | 2 | 1.9 |
| HW1 I | 1 | 3.5 | 2 | 2.0 |
| HW1 A | control | | | 2.1 |

The results show no apparent difference between operation at 1% or 10% consistency in the first stage. The effect of time in the first stage is small but shows a slight preference for the longer time of 4 minutes.

Example 10

Using the process of FIG. 5, a series of runs were made to demonstrate the reuse of first stage filtrate. The chlorinated pulps were identical to those used in Example 8. The alkali charge was 3.3% for the softwood and 1.91% for the hardwood.

Preheated NaOH solution was blended with the pulps in plastic bags and the mixture allowed to react for 1.5 minutes at 40° C. and 10% consistency. The slurry was then filtered on the buchner funnel and washed with treated first stage filtrate from a previous run on the same species. The filtrate had been treated by holding it at 60° C. for a period of time between 5 and 12 minutes. The filtrates from these two operations (the filtration and the wash) were combined and treated at 60° C. as before. The treated combined filtrate was then divided into 2 equal aliquots, one of which was re-added to the pulp and the other saved for use on the next run. The pulp was then reacted at 60° C. for 60 minutes, washed and prepared for CEK number evaulation. For run number SW4 J, the pulp was placed in an atmosphere of pure oxygen at 60° C. for 10 minutes between the washing step following the first stage and before re-adding the treated filtrate. Control tests were the same as those used in Example 8 and will be repeated here for clarity. The results are given in Table XIII.

TABLE XIII

Constant conditions:
First stage consistency = 10%
First stage time = 1.5 min.
First stage temperature = 40° C.
First stage NaOH charge = 3.3% for softwood
First stage NaOH charge = 1.91% for hardwood
Second stage consistency = 10%
Second stage temperature = 60° C.
Second stage time = 60 min.

| Run No. | Gas Used | Filtrate Treatment Time min. | Temp. Deg. C. | CEK No. |
|---|---|---|---|---|
| SW4 I | None | 12 | 60 | 5.2 |
| SW4 J | $O_2$ | 10 | 60 | 5.1 |
| SW4 F | | softwood control | | 5.6 |
| HW3 B | None | 5 | 60 | 2.0 |
| HW3 D | None | 5 | 60 | 2.1 |
| HW3 C | | hardwood control | | 2.3 |
| HW3 G | | hardwood control | | 2.2 |

Comparing these data with Example 8 shows about the same result for hardwood and better results for softwood. The treatment of the filtrate for 5 to 10 minutes at 60° C., therefore, appears adequate to alter, destroy or otherwise render inactive substances in the liquid phase which hinder or retard delignification.

Example 11

A series of runs were made to simulate the process of FIG. 6 using softwood kraft pulp chlorinated with 5.5% chlorine. This was accomplished by repeatedly collecting the filtrate from the first stage of an individual test run, adding an amount of concentrated NaOH solution equivalent in volume to 2% of the total filtrate volume and 3.0% NaOH (o.d. pulp basis), and then treating the mixture at about 50° C. for periods of time ranging from 10 to 60 minutes. This treated filtrate was then added to a fresh sample of pulp for the next run. This procedure was repeated over 8 cycles with the result that the concentration of dissolved lignin in the recycle liquor reached approximately 55 to 60% of its steady state value. For the first cycle, the NaOH solution added to the pulp contained 9% NaOH (o.d. pulp basis), a concentration that was estimated to be approximately equal to the amount of NaOH which should build up in the recirculation stream under steady state condition. The first stage reaction was conducted for 1.0 minute at a temperature between 43° and 47° C. and 3.5% consistency. In the filtration step which followed the pulp consistency was brought to 23% by removal of 87.8% of the liquid phase. The second stage was conducted at 60° C. for 90 minutes. Two controls were run at 3% NaOH, 60° C., and 10% consistency for 90 minutes. The results are given in Table XIV.

TABLE XIV

Constant conditions:
First stage time = 1.0 min.
First state consistency = 3.5%
Second stage consistency = 23%
Second stage temperature = 60° C.
Second stage time = 90 min.

| Run No. | Cycle No. | First Stage Starting liquid | NaOH added % | Temp. Deg C. | Filtrate Treatment Temp. Deg C. | Time min. | CEK No. |
|---|---|---|---|---|---|---|---|
| SW5 B | 1 | water | 9 | 46 | 51 | 10 | 3.4 |
| SW5 C | 2 | Cycle 1 Filtrate | 3 | 45 | 50 | 8 | 3.3 |
| SW5 D | 3 | Cycle 2 Filtrate | 3 | 44 | 49 | 13 | 3.3 |
| SW5 E | 4 | Cycle 3 Filtrate | 3 | 43 | 53 | 10 | 3.3 |
| SW5 F | 5 | Cycle 4 Filtrate | 3 | — | 58 | 12 | 3.3 |
| SW5 H | 6 | Cycle 5 Filtrate | 3 | 47 | 51 | 10 | 3.2 |
| SW5 I | 7 | Cycle 6 Filtrate | 3 | 47 | 60 | 60 | 3.3 |
| SW5 J | 8 | Cycle 7 Filtrate | 3 | | | | 3.3 |
| SW5 A | | control | | | | | 4.1 |
| SW5 G | | control | | | | | 4.0 |

The results show a stable value of CEK number of 3.3 using the process of FIG. 6. This represents an 18.5% reduction in CEK number and shows that the process of this invention can achieve excellent results. The result also shows that the process of FIG. 1, when used at high alkali dosage, can be used as a valid simulation of the process of FIG. 6.

Example 12

A high yield kraft pulp was delignified with oxygen and alkali for 30 minutes at 100° C. and a pressure of 100 psig. The resulting pulp which had a kappa number of 37.3 was chlorinated as described earlier using a chlorine charge of 7.9% and treated according to the process of FIG. 1.

For one of the tests, Run No. OX3, preheated sodium hydroxide solution was blended with fthe pulp at 3% consistency in a Pyrex beaker and allowed to react for one minute at 52° C. and an alkali charge of 12.87%. Using a buchner funnel, 86.4% of the liquid phase was removed bringing the pulp consistency to 18.5%. The second stage treatment was then conducted at 60° C. for 90 minutes. The high alkali dosage of 12.87% used in this test was intended to simulate the process of FIG. 6 as demonstrated in Example 11.

For Run No. OX4, the same procedure was used as for OX3 with the exception that 1.53% hydrogen peroxide (o.d. pulp basis) was added to the sodium hydroxide solution before it was preheated and added to the pulp. The temperature in the first stage for Run No. OX4 was 50° C., and only 85.1% of the liquid phase was removed at the buchner funnel instead of 86.4%. Thus, the pulp consistency in the second stage was 17.2% for Run No. OX4.

Two control runs, OX1 and OX2, were normal extractions conducted at 10% consistency and 60° C. for 90 minutes. Both runs, OX1 and OX2, had a sodium hydroxide charge of 4.29%. For Run No. OX2, however, a 0.55% charge of hydrogen peroxide was also added with the sodium hydroxide.

Following the alkaline treatments described above, the pulps were well washed with deionized water and bleached with sodium hypochlorite. The hypochlorite bleach was conducted at 10% consistency and 50° C. for 60 minutes at a starting pH of 11.5. Hypochlorite dosage was 0.70% expressed as active chlorine and was the same for all tests. After bleaching, the samples were filtered, well washed, formed into pads and analyzed for Elrepho brightness according to TAPPI method T452 om-83 and cupriethylenediamine (CED) viscosity by TAPPI method T230 om-82. The spent liquor from the filtration of the hypochlorite bleaches was analyzed for residual hypochlorite. This enabled calculation of the amount of hypochlorite consumed during the bleach. This is reported in Table XV along with the brightness and viscosity results.

TABLE XV

Constant conditions:
First stage time = 1.0 min.
First stage consistency = 3.0%
First stage alkali = 12.87%
Second stage temperature = 60° C.
Second stage time = 90 min.
Hypochlorite charge = 0.70%

| Run No. | Test Description | Hypochlorite consumed* % | Elephro Brightness % | CED viscosity cp. |
|---|---|---|---|---|
| OX1 | control alkali only | 0.43 | 82.5 | 8.36 |
| OX2 | control 0.55% $H_2O_2$ added | 0.36 | 83.8 | 8.02 |
| OX3 | Process of FIG. 1 alkali only | 0.33 | 83.1 | 8.78 |
| OX4 | Process of FIG. 1 1.5% $H_2O_2$ added | 0.27 | 85.3 | 8.06 |

*as active chlorine, o.d. pulp basis

The results show that the process of this invention can be used to reduce the amount of chemical consumed in subsequent bleaching steps. In addition, comparison of Runs OX2 and OX3 shows that the hypochlorite reduction is equal or better than that obtained by adding a 0.5% charge of peroxide to a normal extraction stage. Further, Run No. OX4 shows that even greater effectiveness is achieved when peroxide is used in the process of this invention. The improvements in brightness and viscosity achieved by the process of this invention over the corresponding control test shows the product benefits gained by application of the process.

The process of this invention has been demonstrated by the Examples 1 through 12 to be an effective method to improve the efficiency of delignification of unbleached softwood kraft, chlorinated softwood kraft, chlorinated hardwood kraft and chlorinated oxygen delignified kraft pulps by extraction with sodium hydroxide. It is further shown in Example 12 that the process is also effective when hydrogen peroxide and sodium hydroxide are used together.

It is proposed that the process of this invention will also improve the efficiency of delignification when other alkaline substances are used. Such alkaline substances as have been used in the prior art for delignification are ammonium hydroxide, lithium hydroxide and other alkali metal hydroxides.

It is further proposed that the process of this invention can be used effectively with a broad range of lignocellulosic materials. A partial list of these lignocellulosic materials would include but should not be limited to the following: nonwood fibrous materials such as bagasse, kenaf, bamboo, grass and other vegetable fiber, unbleached hardwood kraft pulp, unbleached softwood sulfite pulp, unbleached hardwood sulphite pulp, chlorinated softwood sulfite pulp, chlorinated hardwood sulfite pulp, unbleached and chlorinated pulps from all pulping processes on all types of lignocellulosic material, and partially bleached pulp which has had 3 or more stages of bleaching such as CEH, CED and others.

This invention improves the efficiency of pulping and bleaching by providing a technique which achieves greater extraction of lignin without the use of additional chemicals. The improvement in efficiency results in a net reduction in chemical usage and additionally produces a product pulp of higher brightness and higher viscosity.

When used on unbleached pulp as a pre-bleaching or pre-delignification step, it enables reductions in the subsequent demand for chlorine containing bleach agents proportional to the kappa number reduction achieved by the invention. In addition to reduced bleaching costs, this will result in a corresponding reduction in stream pollution by toxic chlorinated organics and BOD because the filtrate from the process can be recirculated through the brownstock washers and eventually be recovered. Unlike oxygen delignification, the process of this invention does not rely on expensive pressurized reactors for its implementation. Instead the process is simple and uses components which are well tested. In addition, there are no added costs or hazards of additional chemicals.

When used for alkaline extraction of chlorinated pulp the process can be operated in a manner to reduce alkali consumption while maintaining the same amount of extraction as measured by the CEK number. This will reduce the operating costs of the bleach plant by an amount equal to the reduced alkali usage. Alternatively, the process has the flexibility which allows it to be operated at alkali consumptions equal to or higher than used in normal bleach plant practice. This enables reductions in CEK number considerably greater than can be achieved by either low presure oxygen extraction or by applying comparable increases in alkali charge to state of the art extraction systems. Only pressurized oxygen systems have reported reductions in CEK number as high or higher than the 36.8% obtained in Example 5, and these require expensive pressurized equipment. Further flexibility is also offered by the fact that the process is effective when peroxide is used in the extraction.

The process can also reduce costs and pollution in another way. It is possible to use the process to reduce chlorine consumption in the first stage of bleaching while maintaining normal levels of alkali charge in the extraction stage. In addition to reducing chlorine costs, this also enables a reduction in pollution from the chlorination filtrate, which is highly toxic to aquatic life.

The process can also be used for both applications simultaneously, the delignification of unbleached pulp and the extraction of chlorinated pulp. This allows the benefits of the process to be realized for both.

The process behaves as if one of the materials which is extracted from pulp by alkali can undergo reactions with the remaining lignin which inhibit its further removal. Condensation reactions are known to occur in delignification, and these are likely the reactions responsible for the inhibition.

When the pulp is first contacted with alkaline solution, these interfering substances are rapidly dissolved. This provides them with greater mobility than they had in the solid phase and condensation reactions begin to occur. The condensation reactions occur somewhat more slowly than the initial dissolution process. Therefore, if the liquid phase is promptly removed from the pulp suspension after the initial dissolution period, the condensation reaction with pulp lignin is effectively blocked by physical separation of the pulp and liquor. The best time to separate the pulp and liquor is when the competition between the condensation reactions and dissolution process begins to favor condensation. This would correspond to the optimum time in the first stage treatment. If the alkali is in contact with the pulp for too short a time, an insufficient amount of the interfering substance is dissolved leading to reduced effectiveness of the process. If too long a period of time passes in the first stage of reaction, the condensation reactions are completed, and the process shows little benefit.

By allowing the liquid phase to sit alone for a period of time after it is removed from the pulp, the condensation reactions occur between dissolved materials present in the separated liquid phase. This effectively eliminates the interfering substances from the solution, allowing the filtrate to be safely contacted with fresh pulp or reunited with the original pulp after the condensation has occurred.

There appears to be a relationship between effectiveness of the process and the concentration of alkali in the first stage. The use of filtrate recycle helps to maintain an elevated concentration in the first stage partly because of the excess alkali available. This facilitates removal of the interfering substances possibly by increased solubility.

Although the terms "pulp" and "wood pulp" are used throughout the specification and claims, the terms are intended to include all types of lignocellulosic fibrous materials, unless otherwise specified. Moreover, the invention has been described in the form of preferred embodiments, but it will be understood that many modifications, additions, and deletions may be made thereto without departure from the spirit and scope of the invention, as set forth in the following claims.

I claim:

1. In the process of manufacturing paper-making pulp in which an alkaline solution is added to wood pulp to cause a reaction that delignifies the pulp, the improvement comprising mixing wood pulp with an alkaline solution containing from about 1.5% to 25% alkali based on oven dry pulp, partially reacting the mixture at a consistency from about 1% to 15% and a temperature from about 20 deg C. to 60 deg C. for about 0.5 to 7 minutes, with the partial reaction time being longer for lower temperatures in the range and shorter for the higher temperatures in the range, withdrawing from about 30% to 90% of the liquid phase from the reacting mixture to raise the consistency of the pulp to about 10% to about 45% before the reaction has been completed, and continuing the reaction of the remaining alkali and pulp at the raised consistency of the pulp at a temperature from about 35 deg C. to 120 deg C. for about 30 to 120 minutes, wherein the withdrawal of liquid phase from the pulp enhances the delignification of the pulp.

2. The process of claim 1 and wherein the step of withdrawing the liquid phase from the reacting mixture comprises withdrawing between 40% and 70% of the liquid phase.

3. The process of claim 1 and wherein the wood pulp is from a group of materials consisting of chlorinated softwood kraft pulp, chlorinated hardwood kraft pulp, unbleached softwood kraft pulp, unbleached hardwood kraft pulp, and chlorinated oxygen delignified kraft pulp.

4. The process of claim 3 and wherein the alkaline solution contains up to about 2% hydrogen peroxide based on oven dry pulp.

5. The process of claim 1 and when the wood pulp is from the list below, the alkaline solution added to the woodpulp contains the percentage of alkali based on oven dry pulp, as indicated below:

| Wood pulp | Alkali added, % |
|---|---|
| Chlorinated hardwood kraft | 1.91 to 11.5 |
| Chlorinated softwood kraft | 3.0 to 9.2 |
| Chlorinated oxygen delignified pulp | 4.29 to 12.87 |

and the step of continuing the reaction comprises continuing the reaction in a temperature range from about 40° C. to about 80° C.

6. The process of claim 1 and wherein the step of partially reacting the mixture comprises partially reacting the mixture for the periods shown in the following table for the temperature shown:

| Temperature °C. | Approximate Time in Minutes |
|---|---|
| 23 | 4–7 |
| 29 | 1.5–4 |
| 35 | 1.0–3.0 |
| 40 | 1.0–2.0 |

-continued

| Temperature °C. | Approximate Time in Minutes |
|---|---|
| 50 | 0.5–1.5 |

7. The process of claim 1 and wherein the step of continuing the reaction of the remaining alkali and pulp comprises continuing the reaction in the presence of oxygen with the temperature of reaction being from about 60° C. to 120° C. at a pressure of 0 to 150 psig.

8. The process of claim 1 and wherein the step of withdrawing the liquid phase comprises moving the reacting mixture of wood pulp and alkali along a path on one surface of a porous conveyor and using a pressure differential to cause movement of the liquid phase through the porous conveyor.

9. The process of claim 8 and wherein the pressure differential is created by applying a vacuum to the other surface of the conveyor to draw the liquid through the conveyor.

10. The process of claim 1 and wherein the step of mixing of the alkaline solution with the pulp comprises spreading the pulp on a moving porous conveyor and distributing alkaline solution on the pulp as the pulp is moved by the conveyor.

11. The process of claim 1 and wherein the pulp and alkaline solution are moved along a path by a conveyor, and wherein the step of withdrawing the liquid phase from the reacting mixture comprises withdrawing the liquid phase at a first position along the path, and further including the step of distributing additional alkaline solution on the pulp at at least one additional position along the path.

12. The process of claim 1 and further including the step of treating at least some of the withdrawn liquid phase, and adding at least some of the treated withdrawn liquid phase to the wood pulp at a point in the process prior to withdrawing the liquid phase from the reacting mixture, wherein the treating of the withdrawn liquid phase is conducted under conditions which suppress the subsequent precipitation of lignin onto the pulp.

13. The process of claim 12 and further including the step of removing from the process flow a volume of withdrawn liquid phase equal to up to about 80% of the total volume of the liquid contained in the pulp entering the process and in the alkali entering the process.

14. The process of claim 12 and further including the step of removing from the process flow a volume of withdrawn liquid phase equal to between 40% and 70% of the total volume of the liquid contained in the pulp entering the process and in the alkali entering the process.

15. The process of claim 1 and wherein the step of mixing wood pulp with an alkaline solution comprises mixing wood pulp with an alkaline solution containing from about 1.5% to about 15% alkali based on oven dry pulp, and wherein the step of partially reacting the mixture comprises partially reacting the mixture at a consistency from about 1% to 11%.

16. The process of claim 12 and wherein the step of adding treated withdrawn liquid phase to the wood pulp comprises adding at least some of the treated withdrawn liquid phase to the wood pulp entering the process.

17. The process of claim 12 and wherein the step of adding treated withdrawn liquid phase to the wood pulp comprises adding at least some of the treated withdrawn liquid phase to the wood pulp at a point in the process after the step of partially reacting the mixture and prior to the step of withdrawing at least some of the liquid phase from the reacting mixture.

18. The process of claim 12 and wherein the step of mixing alkaline solution with the wood pulp comprises first mixing alkaline solution with the withdrawn liquid phase and then introducing the mixture of alkaline solution and withdrawn liquid phase to the pulp.

19. The process of claim 12 and further including the step of washing the pulp with treated withdrawn liquid phase prior to the step of continuing the reaction.

20. The process of claim 12 and wherein the step of treating the withdrawn liquid phase comprises heating the withdrawn liquid phase.

21. The process of claim 20 and wherein the step of heating the withdrawn liquid phase comprises heating the withdrawn liquid phase for a period of about 5 to 60 minutes.

22. The process of claim 20 and wherein the step of heating the withdrawn liquid phase comprises heating the withdrawn liquid phase to a temperature range from 50° C. to 60° C. for a period of at least 8 minutes at the lower end of the temperature range and at least 5 minutes at the higher end of the temperature range.

23. The process of claim 12 and wherein the pulp and alkaline solution are moved along a path by a conveyor, and wherein the step of withdrawing the liquid phase from the reacting mixture comprises withdrawing the liquid phase at a first position along the path, and wherein the step of adding the treated withdrawn liquid phase to the wood pulp comprises distributing the treated withdrawn liquid phase on the pulp at at least one additional position along the path as the pulp moves along the path.

24. The process of claim 19 and wherein the step of washing the pulp with treated withdrawn liquid phase comprises distributing at least some treated withdrawn liquid phase on the pulp at least once as the pulp moves on a porous conveyor and inducing movement of at least some of the treated withdrawn liquid phase present on the pulp through the pulp and through the conveyor following the distribution of treated withdrawn liquid on the pulp.

25. The process of claim 1 and wherein the pulp and alkaline solution are spread on a moving porous conveyor, and wherein the step of partially reacting the mixture occurs at the pulp and alkali move with the conveyor, and wherein the step of withdrawing the liquid phase from the reacting mixture comprises withdrawing the liquid phase through the conveyor as the conveyor moves.

26. The process of claim 25 and further including the step of distributing additional alkaline solution on the pulp as the pulp is moved by the conveyor.

* * * * *